US010968586B1

(12) United States Patent
Weston

(10) Patent No.: US 10,968,586 B1
(45) Date of Patent: Apr. 6, 2021

(54) PET WASTE SCOOPS

(71) Applicant: Bryan Weston, Tacoma, WA (US)

(72) Inventor: Bryan Weston, Tacoma, WA (US)

( * ) Notice: Subject to any disclaimer, the term of this patent is extended or adjusted under 35 U.S.C. 154(b) by 0 days.

(21) Appl. No.: 16/520,502

(22) Filed: Jul. 24, 2019

Related U.S. Application Data

(60) Provisional application No. 62/702,911, filed on Jul. 25, 2018.

(51) Int. Cl.
*E01H 1/12* (2006.01)

(52) U.S. Cl.
CPC ..... *E01H 1/1206* (2013.01); *E01H 2001/128* (2013.01); *E01H 2001/1286* (2013.01)

(58) Field of Classification Search
CPC ..... E01H 1/1206; E01H 2001/122; E01H 2001/1273; E01H 2001/128; E01H 2001/1286
USPC ..... 294/1.3
See application file for complete search history.

(56) References Cited

U.S. PATENT DOCUMENTS 3,560,039 A * 2/1971 Gruber ..... E01H 1/1206 294/1.3
4,225,174 A * 9/1980 Hennessy ..... B25J 1/04 294/1.4
5,503,442 A * 4/1996 Lee ..... E01H 1/1206 294/1.4
6,059,332 A * 5/2000 Beascoechea Inchaurraga ..... E01H 1/1206 294/1.3
7,992,907 B1 * 8/2011 DeJesus ..... E01H 1/1206 294/1.4
8,061,749 B2 * 11/2011 Risch ..... A47J 43/283 294/99.2
8,292,338 B1 * 10/2012 Baghdasaryan ..... E01H 1/1206 294/1.3
8,347,825 B2 * 1/2013 Lopez ..... A01K 27/006 119/795
8,833,816 B2 * 9/2014 Hoffman ..... E01H 1/1206 294/1.3
2009/0261603 A1 * 10/2009 Boghozian ..... E01H 1/1206 294/1.3
2011/0193359 A1 * 8/2011 Howard ..... E01H 1/1206 294/1.3
2017/0191235 A1 * 7/2017 Bean ..... B25J 1/04

FOREIGN PATENT DOCUMENTS

MU 8902713-2 * 7/2011

* cited by examiner

*Primary Examiner* — Dean J Kramer
(74) *Attorney, Agent, or Firm* — Mohr Intellectual Property Law Solutions, PC

(57) ABSTRACT

Scoops for picking up pet waste including a first arm pivotally connected to a second arm at a pivot end, wherein the first arm and the second arm define a collection region distal the pivot end, the second arm being configured to pivot relative to the first arm between an open position and a closed position, the collection region being configured to encompass the pet waste in the collection region when the second arm is in the open position. In certain examples, the scoop includes a coupler configured to facilitate forming a knot in the pet waste bag. In some examples, the scoop includes a container configured to store pet waste bags. In some examples, the scoop includes a latch configured to selectively restrict the second arm pivoting relative to the first arm.

19 Claims, 10 Drawing Sheets

PET WASTE SCOOPS

CROSS REFERENCE TO RELATED APPLICATIONS

This application claims priority to U.S. Application, Ser. No. 62/702,911, filed on Jul. 25, 2018, which is hereby incorporated by reference for all purposes.

BACKGROUND

The present disclosure relates generally to scoops. In particular, scoops for collecting pet waste in a pet waste bag are described.

Collection and disposal of animal waste is an undesirable, but necessary task that animal handlers and caretakers must undertake. The task of collecting pet waste can be made even more difficult when the handler and animal are travelling or ambulating and conventional tools to pick up the animal waste aren't readily available. Tools for collecting pet waste are often referred to as pooper scoopers.

Various known problems with collecting pet waste are noted in the prior art. For example, the prior art describes a lack of an efficient, effective, light weight, and compact portable pooper scoopers. The prior art further reveals that conventional pooper scoopers too often lack a bag dispenser and means to secure pet waste bags. Also evident in the prior art is that known pooper scoopers lack effective means to couple with a leash.

When on a walk, most animal handlers, particularly dog owners, employ the method of turning a bag inside out over their hand for some protection as they manually grasp and retrieve the fecal matter. The plastic bags commonly used in this method are often of a thin ply and may contain holes or imperfections and may be prone to rips and tears. After manually grasping the animal waste in the bag, the user will often utilize both hands to tie a knot in the bag, potentially exposing both hands to waste or foreign materials. There exists a need for a device that limits a person's contact with animal waste and the animal waste bag during the collection and containment of animal waste.

An additional problem with retrieving pet waste that has not been adequately met by the prior art is that users are often left carrying additional pet waste bags and or a bag dispenser on their person. Carrying pet waste bags in one's pocket, satchel, or hand is cumbersome and inconvenient. Thus, another existing need is a solution to the problem of animal handlers needing to carry extra bags separate from conventional pooper scooper tools.

There exist a variety of devices for scooping animal waste comprising various combinations of rakes, spades, and collection containers. Many of the options are designed to minimize the user's need to bend and grasp the waste. As such they are designed with longer lengths to improve the user's reach. The increased reach of such conventional pet waste devices sacrifices portability.

Furthermore, if one were to attempt carrying such a long reach device along while walking the animal, it would distract from the pleasure and bonding shared whilst animal and handler walk together. Additionally, carrying a bulky pooper scooper on a walk could potentially hinder a handler's ability to control the animal if such device were to contact or entangle the leash, body or extremities of the handler or animal. Thus, there exists room for improvement in the prior art to advance and develop a low profile, compact, portable pooper scooper that is conveniently transportable and can easily be carried or hooked onto a leash.

Some pooper scooper examples described in the prior art disclose utilizing customized or modified pet waste bags, such as with cardboard sections, to assist with waste collection. These solutions generally require a user to get in close proximity to and unnecessarily handle animal waste. Such conventional devices also provide a less than optimal solution for handling animal waste on uneven surfaces that may be encountered while walking a dog, such as earthen material including rocks, plant debris, and branches.

Another problem that exists with conventional pet waste scoops is extracting and removing fecal material stuck to an animal, often referred to as danglers, resulting from fecal matter ineffectively evacuating or dislodging from the animal's anus and rectum. In such occasions, the waste material may hang partially dislodged from the anus, but still suspended and tethered to the anus and rectum often via foreign material or string like materials similar in appearance to long hair. In other instances, the fecal matter may adhere to the animal's fur or hair in close proximity to the anal orifice.

When faced with danglers, the animal often appears distraught and uncomfortable and often struggles to dislodge and break the dangler free from its body. The animal often wrestles trying to free themselves from the waste. In some instances, the animal further imbeds the feces into their fur as they attempt to dislodge it.

Often times the animal handler showing compassion for the animal will result to manual extraction of the exposed fecal matter with nothing more than a bag over his or her hand. This can be perceived as unsettling or gross by the animal handler. There are insufficient remedies in the prior art that address this problem, the most common option being the animal owner's hand in a bag. Other apparatus such as spades, rakes, and paddles don't adequately address this problem. Additionally, apparatus that function to catch fecal material as it is excreted likewise don't adequately provide a solution to this problem. Thus, there exists room for advancement and improved solutions to address the problem of danglers.

Another problem that exists with conventional pet waste scoops is that animal handlers must often carry bags with them while walking the animal. Many jurisdictions have laws requiring that animal handlers collect and remove animal waste. A frequent solution employed by animal handlers is to put pet waste bags in their pockets, or to carry a bag dispenser that stores bag rolls. The problem with this approach is that users may utilize such apparatus for dispersing a bag, but then often utilize their hand for collecting the waste material.

An additional problem that exists for animal handlers needing to pick up animal waste is that they lack an effective solution to secure the bag closed by tying a knot in the bag. Manually forming a knot with both hands is cumbersome and a challenge given that animal handlers often must concurrently maintain control of the animal on a leash and hold other items. Tying a knot in a pet waste bag with both hands tends to further increase one's exposure to the bag as well as any potential contamination associated with it.

As is apparent from the discussion above, the current state of prior art leaves room for improvement and advancement in addressing problems associated with picking up pet waste in a hygienic and convenient manner. There exists a need for a solution that incorporates a portable pooper scooper with a bag dispenser and a bag securing solution.

There exists in the prior art a solution of using two independent bodies in combination, such as, a rake or shovel and a collection bin. While such devices work adequately at a fixed station or location, they are impractical and cumbersome for an animal handler to carry while ambulating or transporting an animal. Such devices do not adequately address the problems associated with safely, effectively, and efficiently managing animal waste, particularly in a state of travel, or while ambulating with an animal.

There are a variety of devices in the prior art with complex designs requiring significant manufacturing and assembly. The complexity of such devices makes manufacturing them difficult and potentially makes the devices more prone to breakage or wear.

One prior art example entitled "Pooper Scoop," U.S. Pat. No. 8,550,512, which is hereby incorporated by reference, discloses capturing animal feces as it is excreted. The device shown in U.S. Pat. No. 8,550,512 creates the problem of needing to collect excrement that falls outside the catch area of the device. Additionally, devices such as this don't provide a solution to the problem of danglers.

Some devices in the prior art require immediate disposal of the collected pet waste contents, thus necessitating proximity to a refuse container, a waste receptacle, or other containment unit. Immediately disposing of full pet waste bags might not be an option for a person transporting or walking an animal. Some devices in the prior art allow the user to transport the waste collected between the scoops, but pet waste retained in the device renders the device essentially useless for collecting more pet waste until the pet waste is disposed of in a waste receptacle. Devices designed in this manner do not permit the user to utilize the devices repeatedly and frequently when out of proximity to a waste receptacle.

In summary, the prior art related to pet waste scoops offers certain options and proposed solutions, but there remain areas for distinct improvement. In particular, areas where pet waste scoops would benefit from improvement include the manner in which animal waste is collected and contained, their transportability, their integration with a leash, their pet waste bag storage capabilities, their ability to remove danglers, and their ability to assist with sealing bags closed.

SUMMARY

The present disclosure is directed to scoops for picking up pet waste including a first arm pivotally connected to a second arm at a pivot end, wherein the first arm and the second arm define a collection region distal the pivot end, the second arm being configured to pivot relative to the first arm between an open position and a closed position, the collection region being configured to encompass the pet waste in the collection region when the second arm is in the open position. In certain examples, the scoop includes a coupler configured to facilitate forming a knot in the pet waste bag. In some examples, the scoop includes a container configured to store pet waste bags. In some examples, the scoop includes a latch configured to selectively restrict the second arm pivoting relative to the first arm.

DETAILED DESCRIPTION

Figure 1:
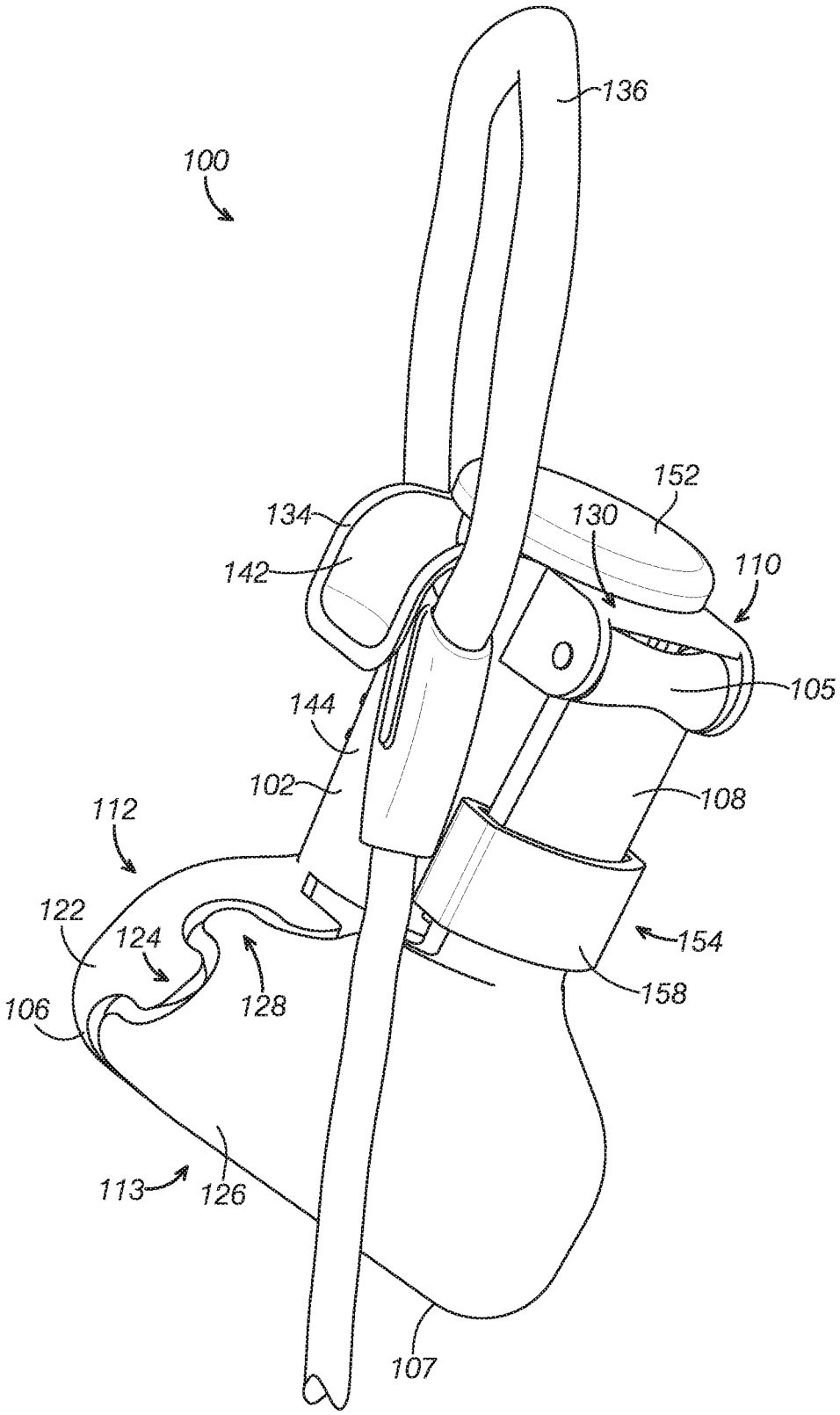
FIG. 1 is a perspective view of a first embodiment of a scoop hanging from a leash.

The disclosed scoops will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various scoops are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Pet Waste

In the present document, pet waste will be used to generally describe any form of animal fecal matter or waste of which one endeavors to collect and dispose. The term pet in pet waste is in reference to a common scenario involving collecting waste from a pet when walking in public, but is not intended to exclude waste from other animals not considered pets. In the present example, pet waste 101 is fecal matter from a dog.

Pet Waste Bag

The features of pet waste bag 114 will first be described to aid the discussion of the scoops disclosed herein. Pet waste bag 114 functions to contain pet waste 101 and to isolate pet waste 101 while transporting it to a place where it may be disposed, such as a waste bin.

Figure 7:
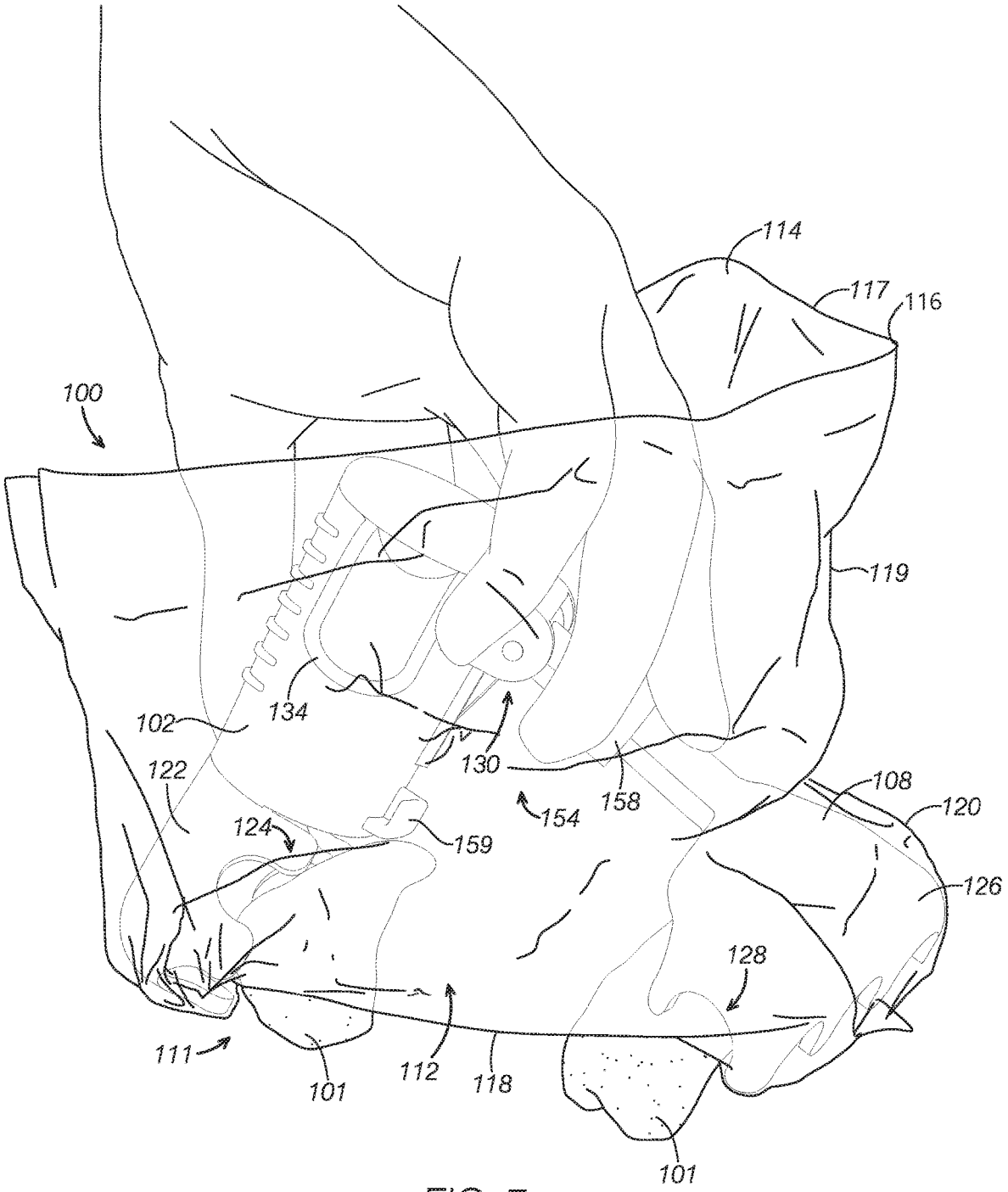
FIG. 7 is a view of the scoop inside a pet waste bag with the arms in an open position and surrounding pet waste to be collected.
Figure 8:
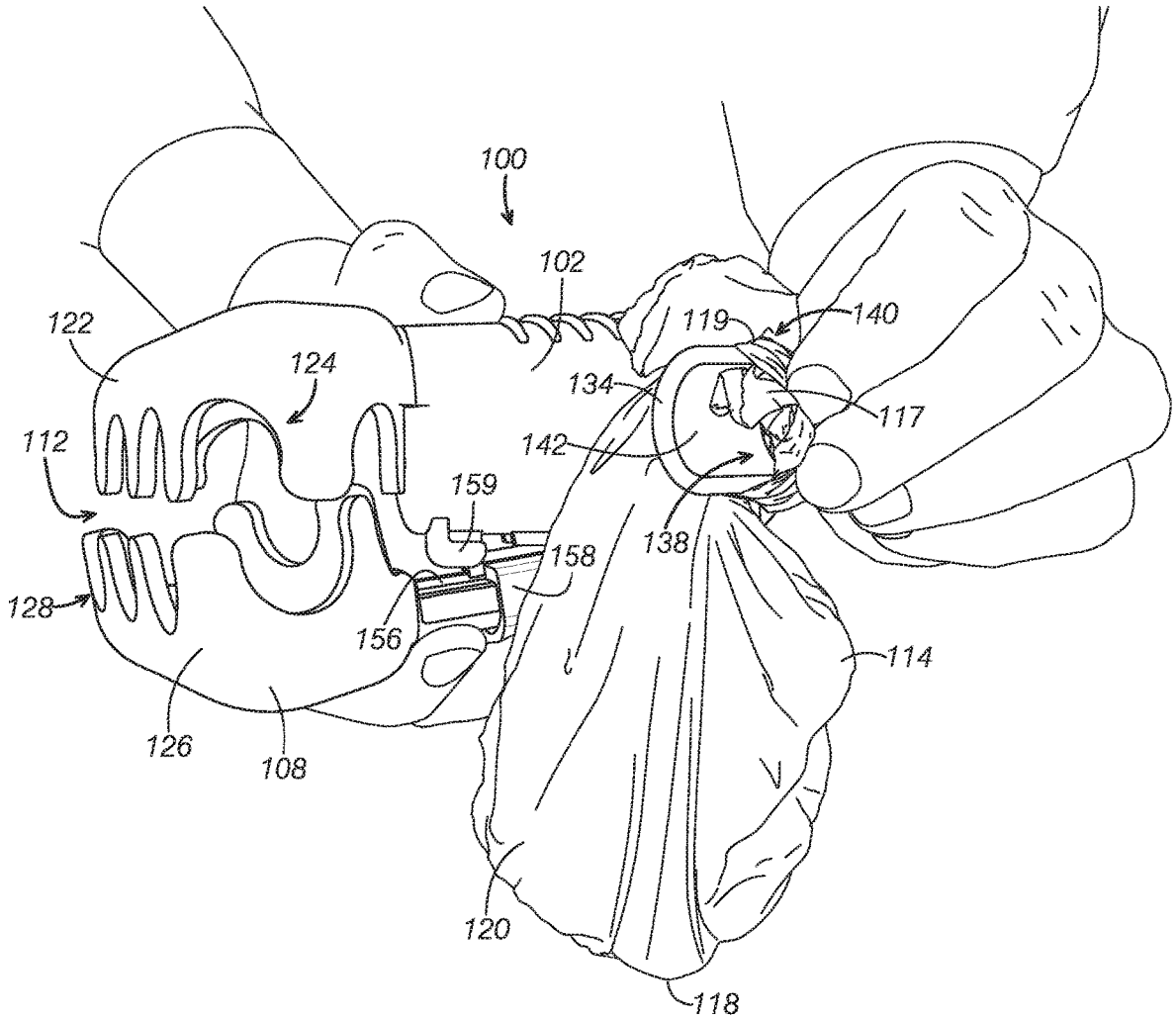
FIG. 8 is a view of the scoop supporting a pet waste bag containing pet waste on a coupler and a knot being formed in the pet waste bag by a user pushing a portion of the pet waste bag along a channel formed in the coupler.

As shown in FIGS. 7 and 8, pet waste bag 114 includes a top end 117 defining an opening 116. In the example shown in FIGS. 7 and 8, pet waste bag 114 and has a bottom 118 opposite opening 116. A pouch 120 for containing pet waste 101 is defined between opening 116 and bottom 118. Pouch 120 includes a neck 119 proximate opening 116.

In the present example, pet waste bag 114 is comprised of a plastic material and may be any suitable material for containing and transporting pet waste. The pet waste bag may be any currently known or later developed type of pet waste bag.

Leash

As shown in FIG. 1, the scoops disclosed herein may cooperate with a leash 136. Leash 136 is an elongate tension bearing member configured to restrict an animal from moving beyond a certain distance from a person holding the leash. The length of the leash defines how far away the animal may be from the person holding the leash. The scoops discussed here may cooperate with any currently known or later developed style of leash.

Pet Waste Scoops

With reference to the figures, pet waste scoops will now be described. The scoops discussed herein function to pick up pet waste for purposes of disposing of the pet waste in a disposal bin or the like. The scoops enable a user to pick up the pet waste without coming into direct contact with the pet waste and without having to feel the pet waste through a thin pet waste bag. In some examples, the scoops function to store and dispense pet waste bags and to couple to a leash, clothing, or one's person for hands-free transporting. The scoops further function to assist to form knots in the pet waste bags containing pet waste to seal them closed.

The reader will appreciate from the figures and description below that the presently disclosed scoops address many of the shortcomings of conventional scoops. For example, the scoops collect pet waste more conveniently and hygienically than conventional pet waste devices. Further, the present scoops are easier and more convenient to transport than known pet waste devices.

The scoops disclosed herein further improve over currently known pet waste devices by storing and dispensing pet waste bags. An important advancement over conventional pet waste devices is the present scoops' ability to assist with forming knots in pet waste bags containing pet waste to seal the pet waste bags closed. A further advantage of the presently disclosed scoops is their ability to remove danglers, that is, pet waste affixed to an animal.

Scoop Embodiment One

With reference to FIGS. 1-9, a first example of a scoop, scoop 100, will now be described. Scoop 100 includes a first arm 102, a second arm 108, a pivot mechanism 130, a coupler 134, a container 144, and a latch 154.

In some examples, the scoop does not include one or more features included in scoop 100. For example, some scoop examples do not include a pivot mechanism, a coupler, a container, or a latch. In other examples, the scoop includes additional or alternative features, such as a tether.

Arms

As can be seen in FIGS. 1-9, first arm 102 extends from a base end 104 to a collection end 106 and second arm 108 extends from a base end 105 to a collection end 107. As shown in FIGS. 1-3 and 6-9, base end 105 of second arm 108 is pivotally connected to base end 104 of first arm 102 to define a pivot end 110. First arm 102 and second arm 108 define a collection region 112 between collection end 106 of first arm 102 and collection end 107 of second arm 108. Collection region 112 extends towards pivot end 110.

In the example shown in FIGS. 1-9, first arm 102 and second arm 108 are comprised of a plastic material. In other examples, the arms are comprised of other materials, such as metal, wood, or composites. The arms may be comprised of any currently known or later developed material suitable for pet waste scoops.

In the present example, collection end 106 of first arm 102 defines a first bucket 122 configured to receive pet waste 101 and collection end 107 of second arm 108 is similarly configured. In particular, collection end 107 of second arm 108 defines a second bucket 126 configured to receive pet waste 101. As shown in FIGS. 1-9, bucket 122 defines a first toothed profile 124 proximate collection region 112 and second bucket 126 defines a second toothed profile 128 extending around collection region 112 towards first arm 102. The reader can see in FIGS. 1, 2, and 4-6 that first toothed profile 124 and second toothed profile 128 are configured to intermesh when second arm 108 is in closed position 113.

To facilitate collecting pet waste 101, second arm 108 is configured to pivot relative to first arm 102 between an open position 111 and a closed position 113. As shown in FIG. 7, collection end 106 of second arm 108 is spaced from collection end 106 of first arm 102 a distance sufficient to encompass pet waste 101 in collection region 112 in open position 111. With reference to FIGS. 1, 2, and 4-6, collection end 107 of second arm 108 is proximate to collection end 106 of first arm 102 in the closed position.

The reader can see in FIG. 7 that first arm 102 and second arm 108 are complementarily configured with a pet waste bag 114. In the present example, collection region 112 is configured to fit inside pouch 120 proximate bottom 118 with first arm 102 and second arm 108 in open position 111.

The reader will appreciate from FIG. 7 that scoop 100 is configured to collect pet waste 101 in pouch 120 when collection region 112 is inside pouch 120. Scoop 100 collects pet waste 101 by a user moving second arm 108 to open position 111 and over pet waste 101 to surround pet waste 101 with bottom 118 and pouch 120 of pet waste bag 114 in collection region 112. A user then moves second arm 108 to closed position 113 to encompass pet waste 101 in pouch 120 in collection region 112.

Pivot Mechanism

In the example shown in FIG. 1-9, pivot mechanism 130 pivotally connects second arm 108 to first arm 102 at pivot end 110. In other examples, such as shown in FIG. 10, the arms are pivotally connected with a living hinge instead of a pivot mechanism.

Figure 9:
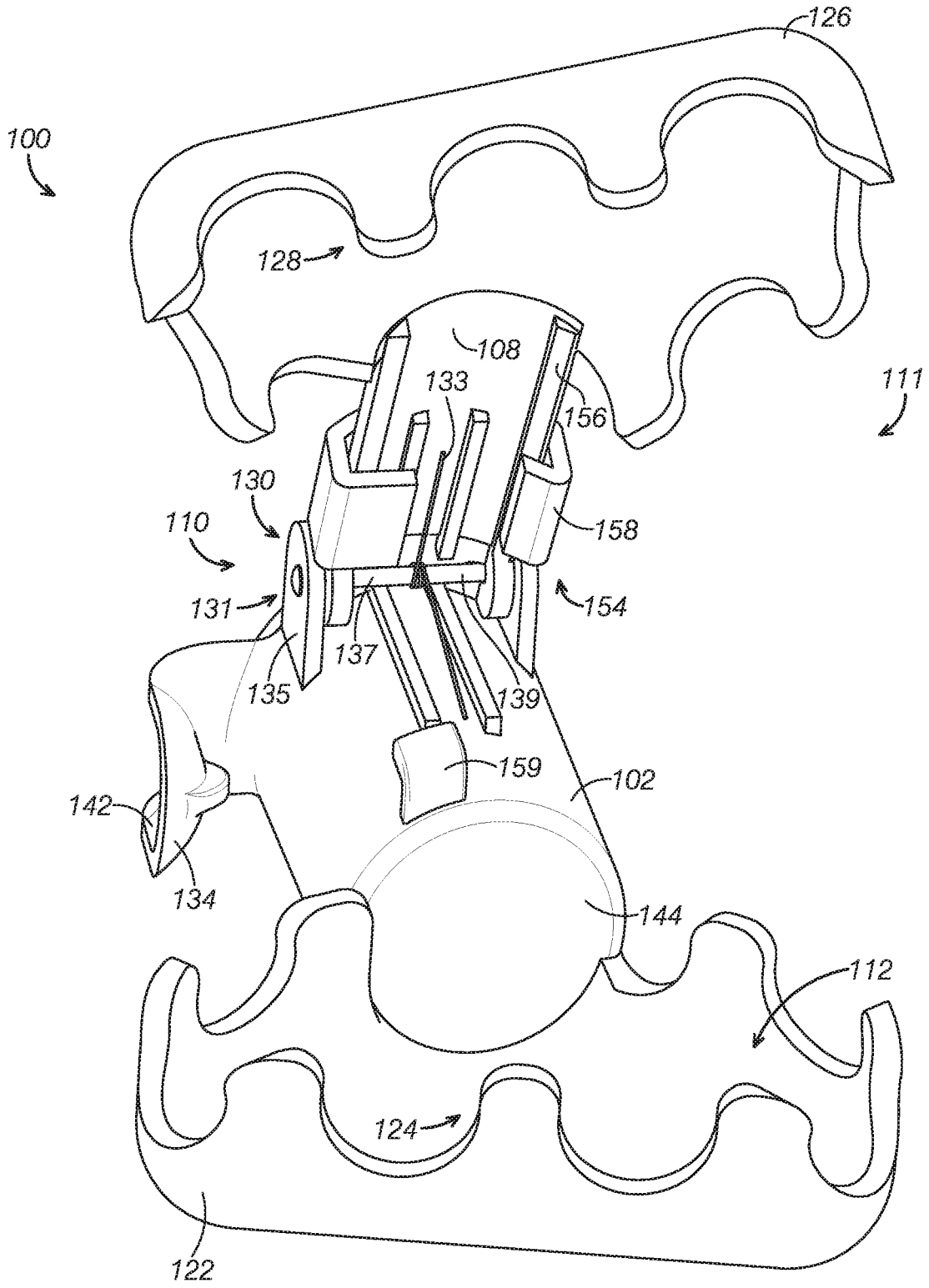
FIG. 9 is a close up view of a pivot mechanism of the scoop shown in FIG. 1.
Figure 10:
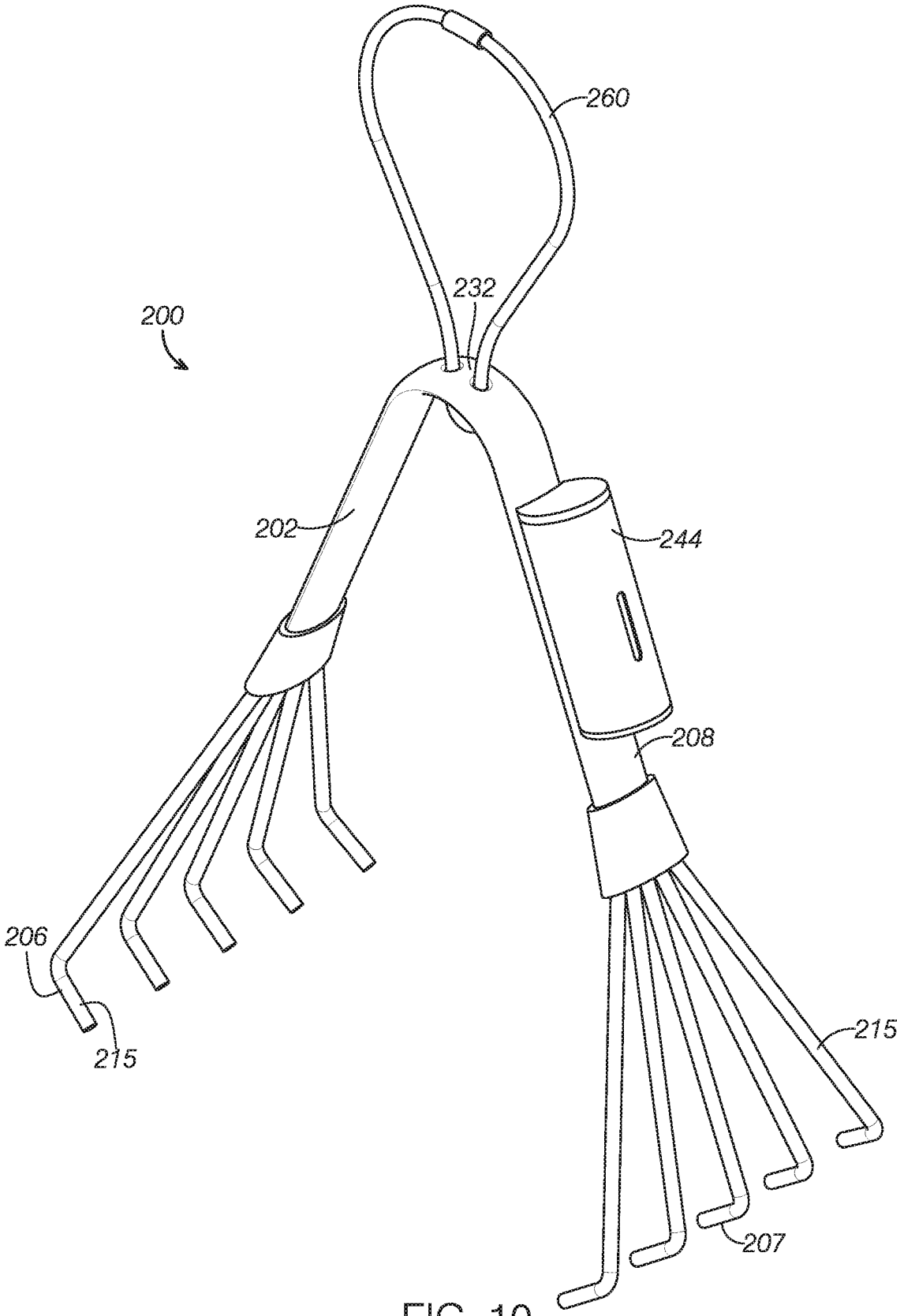
FIG. 10 is a perspective view of a second embodiment of a scoop, the scoop including a tether and arms with tines and pivotally connected via a living hinge.

With reference to FIG. 9, the reader can see that pivot mechanism 130 includes an axel 131 and a spring 133 disposed on axel 131. Axel 131 rotationally couples second arm 108 to first arm 102 and spring 133 bias second arm 108 towards the open position depicted in FIG. 9. In use, a user may overcome the bias of spring 133 to move second arm 108 into the closed position depicted in FIGS. 1, 2, and 4-6.

In the present example, axel 131 includes bearings 135 mounted to first arm 102, rod 137 mounted to bearings 135, and collars 139 supported on rod 137 and coupled to second arm 108. In the example shown in FIG. 9, rod 137 is rotationally mounted to bearings 135 and collars 139 are fixed to rod 137. Thus, when rod 137 rotates relative to bearings 135, collars 139 and second arm 108 rotate in turn. Spring 133 is a torsion spring supported on rod 137 with first and second legs engaging first arm 102 and second arm 108, respectively, to bias them apart. In other examples, the scoop includes other structure combinations suitable for enabling the second arm to pivot relative to the first arm.

Coupler

As shown in FIG. 1, coupler 134 is configured to couple with a leash 136. Coupler 134 is attached to first arm 102 and curved to define a hook configured to engage and hang from leash 136. Additionally or alternatively to coupling with leash 134, coupler 134 may couple with a belt, belt loops, a pocket, a strap on a satchel, or various other points on a person's clothing or on items a person is carrying.

With reference to FIG. 8, the reader can see that coupler 134 is complementarily configured with pet waste bag 114 and configured to facilitate forming a knot 138 in pet waste bag 114. As shown in FIG. 8, coupler 134 is configured to facilitate forming a knot 138 in pet waste bag 114 by supporting pet waste bag 114 at neck 119 when pet waste bag 114 contains pet waste 101. Supporting pet waste bag 114 at neck 119 facilitates forming a loop 140 with pet waste bag 114. As shown in FIG. 8, once the loop 140 is formed, a user may pass top end 117 through loop 140 to define knot 138.

As can be seen in FIG. 8, coupler 134 defines a channel 142 complementarily configured with a finger. Channel 142 facilitates the finger pushing or pulling top end 117 through loop 140 formed in pet waste bag 114 by laterally bounding the finger pushing or pulling top end 117 of pet waste bag 114. Laterally bounding the path of the finger helps guide the finger to move top end 117 of pet waste bag longitudinally along channel 142 through loop 140.

Container

Container 144 is configured to store pet waste bags 114 to make bringing and accessing the bags on walks with animals more convenient. In the example shown in FIGS. 1-9, container 144 is integrally formed in first arm 102 and defines a cylindrical void 146 configured to receive a roll of pet waste bags 114. In other examples, such as with soft-sided container 244 attached to first arm 202 depicted in FIG. 10, the container is attached to the first or second arm fixedly or removably.

Figure 6:
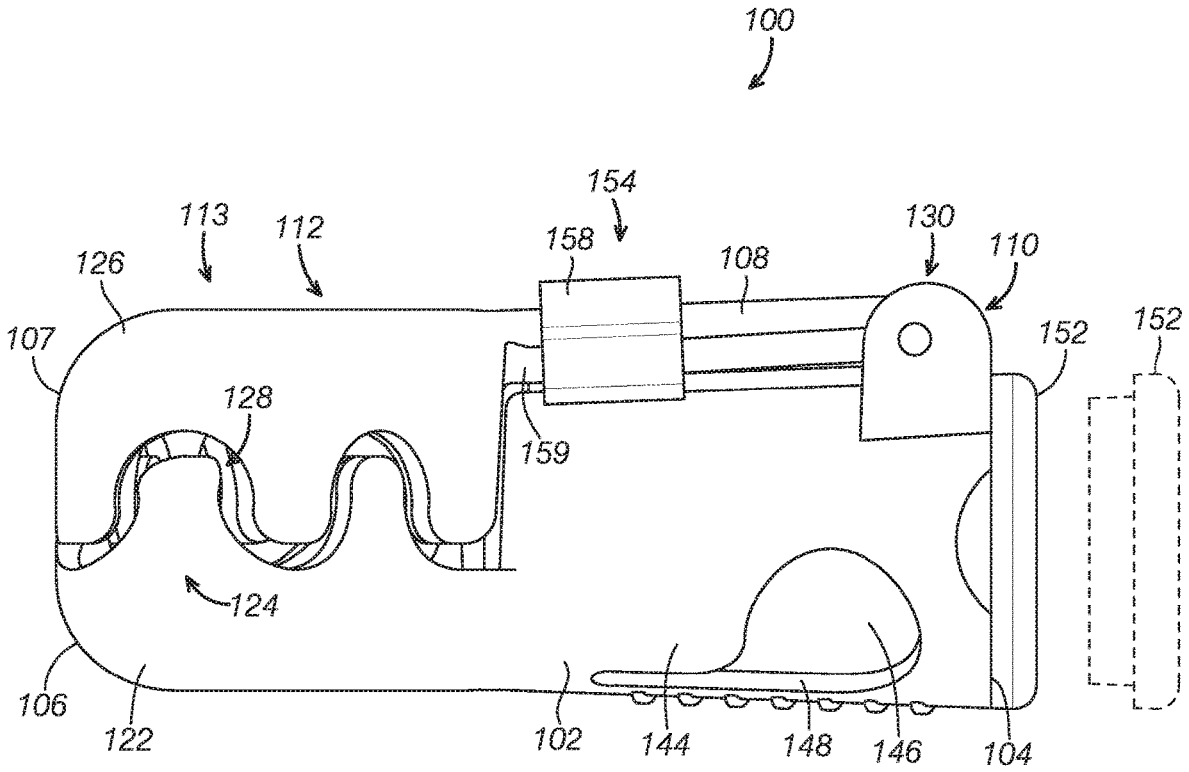
FIG. 6 is a right side elevation view of the scoop shown in FIG. 1 depicting a dispenser through which pet waste bags in the container may be accessed and a cap for covering the container mounted on the end of the container.

With reference to FIG. 6, the reader can see that container 144 defines a dispenser 148 through which a roll of pet waste bags 114 in container 144 may be accessed. In the present example, dispenser 148 is an apostrophe shaped opening formed in container 144. In other examples, the dispenser is an opening with different shapes, such as round, triangular, square, another regular polygon, or irregular. In some examples, the dispenser defines a slit. In certain examples, the dispenser includes mechanical components to assist with dispensing a bag from the container.

Figure 5:
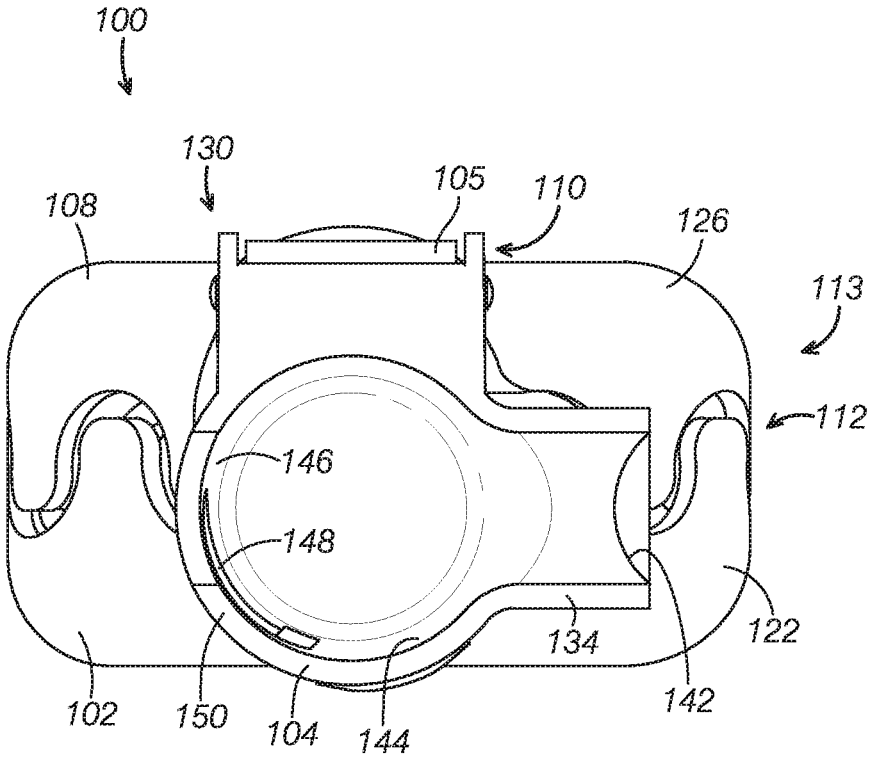
FIG. 5 is a rear elevation view of the scoop shown in FIG. 1 depicting a container for storing pet waste bags.

As shown in FIG. 5, container 144 defines an inlet 150 providing access to cylindrical void 146. A user may place pet waste bags 114 into container 144 through inlet 150 to then be accessed via dispenser 148. The cylindrical shape of void 146 complements a cylindrical roll of pet waste bags 144.

To selectively cover inlet 150 and cylindrical void 146, container 144 includes a cap 152. As shown in FIG. 6, cap 152 is removably attached to inlet 150. Cap 152 selectively couples to inlet 150 to selectively cover cylindrical void 146. In the present example, cap 152 selectively couples to inlet 150 via an interference fit, but any suitable means for removably attaching the cap to the inlet may be used.

Latch

Latch 154 functions to selectively restrict second arm 108 pivoting relative to first arm 102. By utilizing latch 154, a user may maintain scoop 100 in the closed position and selectively release scoop 100 to move to the open position.

As shown in FIGS. 1-3 and 6-9, latch 154 is connected to first arm 102 and to second arm 108. In the example shown in FIGS. 1-9, latch 154 includes a rail 156 mounted to second arm 108, a catch 158 moveably mounted to rail 156, and an anchor 159 fixedly mounted to first arm 102. In other examples, different mechanical features are provided to selectively restrict the second arm from pivoting relative to the first arm.

Figure 2:
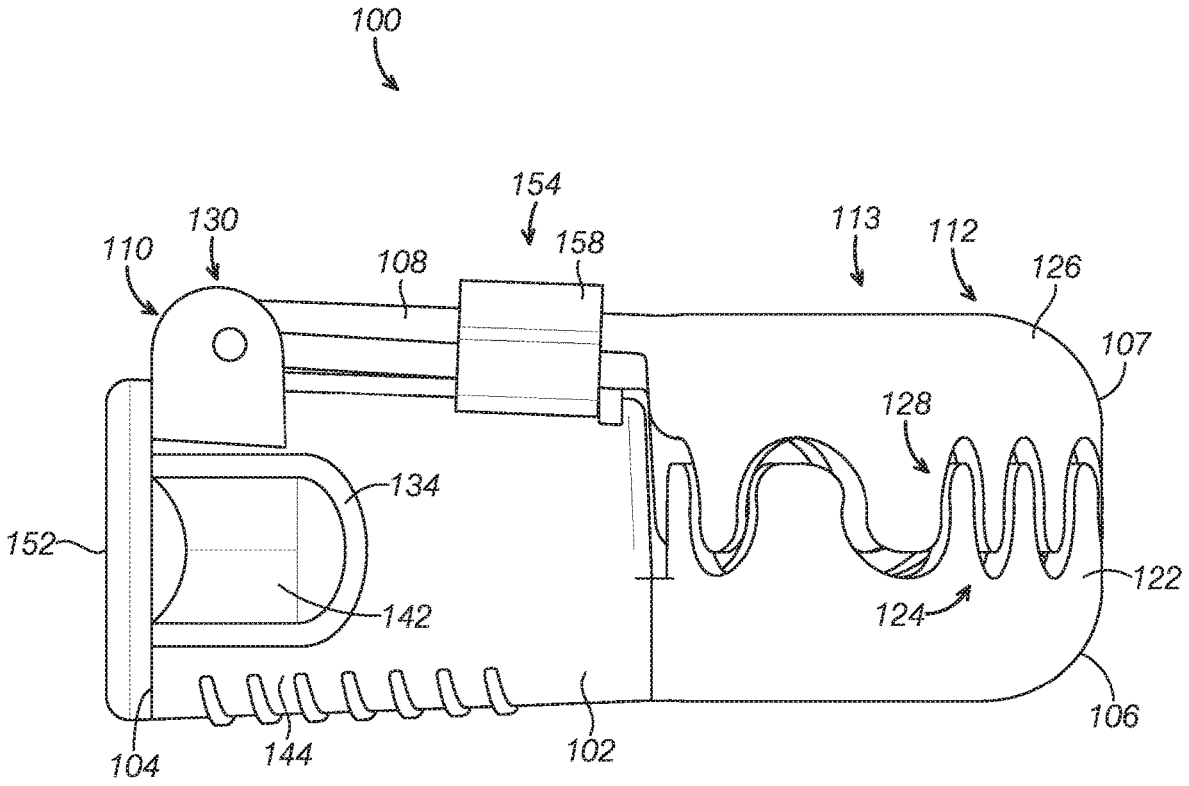
FIG. 2 is a left side elevation view of the scoop shown in FIG. 1 depicting the arms in a closed position and a latch with a catch in a lock position.
Figure 3:
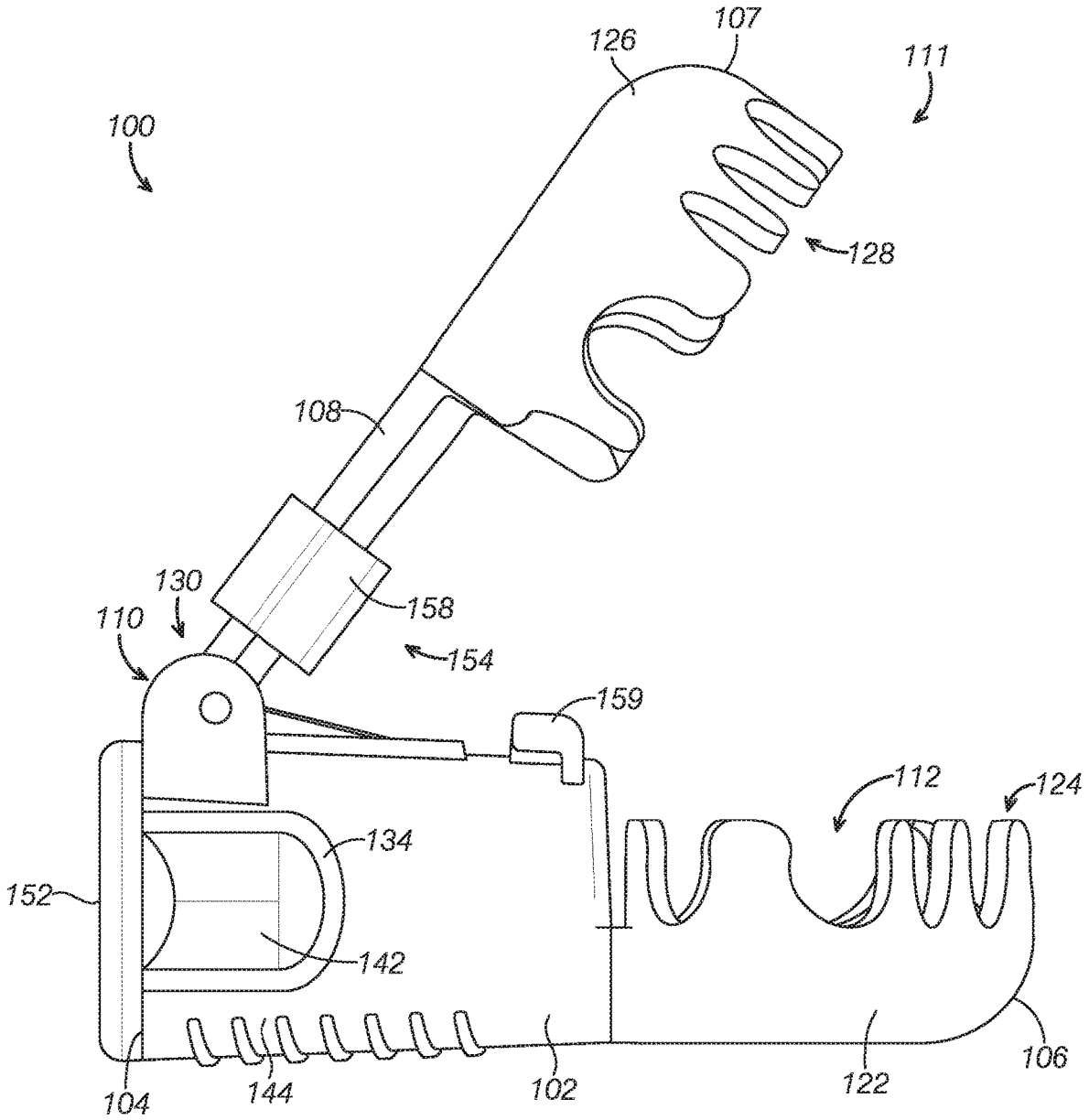
FIG. 3 is a left side elevation view of the scoop shown in FIG. 1 depicting the arms in an open position and the catch in a release position.
Figure 4:
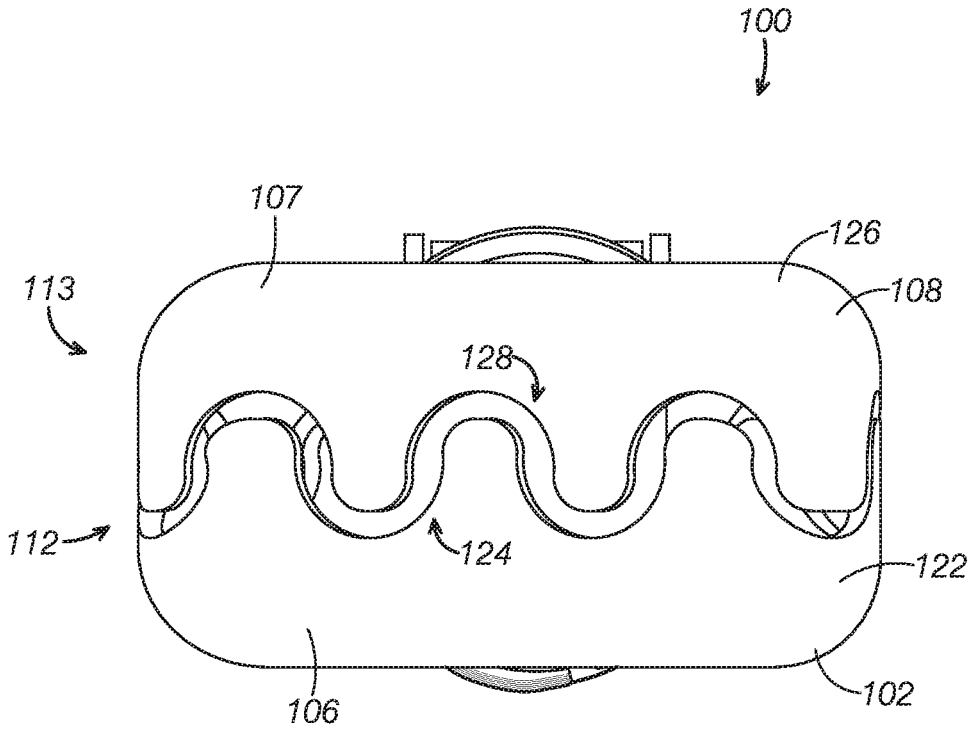
FIG. 4 is a front elevation view of the scoop shown in FIG. 1 depicting the arms in a closed position and teeth formed in each arm intermeshing.

In the present example, catch 158 is configured to move along rail 156 between a lock position shown in FIG. 2 and a release position shown in FIG. 3. In the lock position, catch 158 engages anchor 159 mounted to first arm 102 to restrict second arm 108 pivoting relative to first arm 102. In the release position, catch 158 is in a position on rail 156 spaced from anchor 159. When catch 158 is disengaged from anchor 158, second arm 108 may pivot relative to first arm 102 from the bias of spring 133 or by manually moving second arm 108.

Scoop Embodiment Two

Turning attention to FIG. 10, a second example of a scoop, scoop 200, will now be described. Scoop 200 includes many similar or identical features to scoop 100. Thus, for the sake of brevity, each feature of scoop 200 will not be redundantly explained. Rather, key distinctions between scoop 200 and scoop 100 will be described in detail and the reader should reference the discussion above for features substantially similar between the two scoops.

Scoop 200 functions to collect pet waste in a manner similar to scoop 100. As can be seen in FIG. 10, scoop 200 includes a first arm 202, a second arm 208, a living hinge 232, a container 244, and a tether 260.

Unlike scoop 100 where first arm 102 and second arm 108 pivotally connect via mechanical pivot mechanism 130, in scoop 200, second arm 208 pivotally connects to first arm 202 via a living hinge 232. Living hinge 232 enables first and second arms 202 and 208 to pivot between the open position shown in FIG. 10 and a closed position where the arms are proximate each other to collect pet waste between them. In the scoop 200 example, first and second arms 202 and 208 are integrally connected and could thus be described as a single arm divided into two portions.

As can be seen in FIG. 10, first and second arms 202 and 208 terminate with tines 215 proximate their collection ends 206 and 207, respectively. Whereas the arms in the scoop 100 example terminated in buckets, first and second arms 202 and 208 terminate in tines 215 to facilitate collecting pet waste between them. Tines 215 are configured to be flexible enough to deflect by a selected amount when dragged over a surface to better conform to the contours of the surface yet to also be rigid enough to collectively grasp and contain pet waste.

In comparison to container 144 integrally formed in first arm 102 in scoop 100, scoop 200 includes a discrete container 244 attached to second arm 208. In other examples, the container is attached to the first arm. In certain examples, the scoop includes multiple containers attached to one or both arms.

In the present example, container 244 contains non-rigid walls made of canvas. In other examples, the walls of the container are made from other textiles. In some examples, the walls of the container are rigid and formed of plastic, metal, wood or other suitable rigid material. The container may be any currently known or later developed container suitable for storing and/or dispensing pet waste bags.

Living hinge 232 facilitates carrying scoop 200 on one's wrist or on a clip secured to one's clothing or items being carried. Utilizing tether 260 to carry scoop 200 frees one's hands to perform other tasks and makes carrying scoop 200 more convenient.

The reader can see in FIG. 10 that tether 260 is coupled to living hinge 232. As discussed above, living hinge 232 may be described as a portion of a common arm member comprised of first and second arms 202 and 208, respectively. In the present example, tether 260 is an elongate tension bearing member. In other examples, the tether may be or incorporate a hook or other fastener, such as hook and loop material, magnets, or adhesives. The tether may be any currently known or later developed member or mechanism for releasably securing items.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A scoop for picking up pet waste, comprising:

a first arm extending from a base end to a collection end;

a second arm extending from a base end to a collection end, the base end of the second arm being pivotally connected to the base end of the first arm to define a pivot end;

wherein:

the first arm and the second arm define a collection region between the collection end of the first arm and the collection end of the second arm, the collection region extending towards the pivot end;

the second arm is configured to pivot relative to the first arm between an open position and a closed position;

the collection end of the second arm is spaced from the collection end of the first arm a distance sufficient to encompass the pet waste in the collection region in the open position; and the collection end of the second arm is proximate to the collection end of the first arm in the closed position; and a latch operatively connected to the first arm and to the second arm to selectively restrict the second arm pivoting relative to the first arm, wherein the latch includes a rail mounted to the second arm and a catch moveably mounted to the rail, the catch being configured to move between a lock position restricting the second arm pivoting relative to the first arm and a release position allowing the second arm to pivot relative to the first arm.

2. The scoop of claim 1, wherein:

the first arm and the second arm are complementarily configured with a pet waste bag;

the pet waste bag:

defines an opening, has a bottom opposite the opening, and defines a pouch between the opening and the bottom, the collection region is configured to fit inside the pouch proximate the bottom with the first arm and the second arm in the open position; and the scoop is configured to collect pet waste in the pouch when the collection region is inside the pouch by moving the second arm to the open position and over the pet waste to surround the pet waste with the bottom and the pouch of the pet waste bag in the collection region and then moving the second arm to the closed position to encompass the pet waste in the pouch in the collection region.

3. The scoop of claim 1, wherein the collection end of the first arm defines a bucket configured to receive the pet waste.

4. The scoop of claim 3, wherein the bucket defines a toothed profile proximate the collection region.

5. The scoop of claim 4, wherein:

the bucket defines a first bucket;

the toothed profile defines a first toothed profile the collection end of the second arm defines a second bucket configured to receive the pet waste; and the second bucket defines a second toothed profile extending around the collection region towards the first arm.

6. The scoop of claim 5, wherein the first toothed profile and the second toothed profile are configured to intermesh when the second arm is in the closed position.

7. The scoop of claim 1, wherein the first arm defines tines proximate the collection end of the first arm.

8. The scoop of claim 1, further comprising a pivot mechanism at the pivot end to pivotally connect the second arm to the first arm.

9. The scoop of claim 1, wherein the second arm pivotally connects to the first arm via a living hinge.

10. The scoop of claim 1, further comprising a coupler attached to the first arm, the coupler being configured to couple with a leash.

11. The scoop of claim 10, wherein:

the coupler is complementarily configured with a pet waste bag;

the pet waste bag:

includes a top end defining an opening, has a bottom opposite the opening, defines a pouch between the opening and the bottom, the pouch including a neck proximate the opening; and the coupler is configured to facilitate forming a knot in the pet waste bag by supporting the pet waste bag at the neck when the pet waste bag contains pet waste to facilitate forming a loop with the pet waste bag and passing the top end through the loop to define the knot.

12. The scoop of claim 1, further comprising a tether operatively connected to one or more of the first arm and the second arm.

13. A scoop for picking up pet waste, comprising:

a first arm extending from a base end to a collection end;

a second arm extending from a base end to a collection end, the base end of the second arm being pivotally connected to the base end of the first arm to define a pivot end;

wherein:

the first arm and the second arm define a collection region between the collection end of the first arm and the collection end of the second arm, the collection region extending towards the pivot end;

the second arm is configured to pivot relative to the first arm between an open position and a closed position;

the collection end of the second arm is spaced from the collection end of the first arm a distance sufficient to encompass the pet waste in the collection region in the open position; and the collection end of the second arm is proximate to the collection end of the first arm in the closed position; and a coupler attached to the first arm, the coupler being configured to couple with a leash, wherein the coupler is complementarily configured with a pet waste bag;

the pet waste bag:

includes a top end defining an opening, has a bottom opposite the opening, defines a pouch between the opening and the bottom, the pouch including a neck proximate the opening; and the coupler is configured to facilitate forming a knot in the pet waste bag by supporting the pet waste bag at the neck when the pet waste bag contains pet waste to facilitate forming a loop with the pet waste bag and passing the top end through the loop to define the knot; and wherein the coupler defines a channel complementarily configured with a finger to facilitate the finger moving the top end through the loop formed in the pet waste bag.

14. The scoop of claim 1, further comprising a container operatively connected to the first arm and configured to store pet waste bags.

15. The scoop of claim 1, further comprising a container integrally formed in the first arm and configured to store pet waste bags, the container defining a cylindrical void configured to receive a roll of pet waste bags.

16. The scoop of claim 15, wherein the container defines a dispenser through which the roll of pet waste bags in the container may be accessed.

17. The scoop of claim 15, wherein:

the container defines an inlet providing access to the cylindrical void;

the container includes a cap selectively coupled to the inlet to selectively cover the cylindrical void.

18. The scoop of claim 17, wherein the cap selectively couples to the inlet via an interference fit.

19. A scoop for picking up pet waste, comprising:

a first arm extending from a base end to a collection end;

a second arm extending from a base end to a collection end, the base end of the second arm being pivotally connected to the base end of the first arm to define a pivot end;

wherein:

the first arm and the second arm define a collection region between the collection end of the first arm and the collection end of the second arm, the collection region extending towards the pivot end;

the second arm is configured to pivot relative to the first arm between an open position and a closed position;

the collection end of the second arm is spaced from the collection end of the first arm a distance sufficient to encompass the pet waste in the collection region in the open position; and the collection end of the second arm is proximate to the collection end of the first arm in the closed position;

a torsion spring engaging the first arm and the second arm, wherein the torsion spring biases the second arm outwardly from the first arm to place the scoop in an open position; and a latch operatively connected to the first arm and to the second arm to selectively restrict the second arm pivoting relative to the first arm, wherein the latch includes a rail mounted to the second arm and a catch moveably mounted to the rail, the catch being configured to move between a lock position restricting the second arm pivoting relative to the first arm and a release position allowing the second arm to pivot relative to the first arm.

* * * * *